United States Patent [19]

Young

[11] 4,336,936

[45] Jun. 29, 1982

[54] PORTABLE GAME SURFACE FOR A POOL-LIKE GAME

[76] Inventor: Richard L. Young, 10266 Hammerly, Houston, Tex. 77043

[21] Appl. No.: 168,619

[22] Filed: Jul. 14, 1980

[51] Int. Cl.[3] ..... A63D 13/00; A63D 15/02

[52] U.S. Cl. ..... 273/2; 273/8; 273/12

[58] Field of Search ..... 273/2, 3 R, 5 A, 11 R, 273/12, 6, 8, 127 B, 77 R, 176 F, 123 R, 4 R, 7, 9, 69, 126 R, 85 R

[56] References Cited

U.S. PATENT DOCUMENTS

| | | | |
|---|---|---|---|
| 364,677 | 6/1887 | Schoeing | 273/5 A |
| 810,224 | 1/1906 | Sackett | 273/3 B |
| 1,661,965 | 3/1928 | Ruse et al. . | |
| 1,669,822 | 5/1928 | Gregg . | |
| 2,417,615 | 3/1947 | Rothe | 273/85 R |
| 2,462,526 | 2/1949 | McNair . | |
| 2,540,729 | 2/1951 | Haskell . | |
| 2,809,040 | 10/1957 | Trovato | 273/4 R |
| 3,591,176 | 10/1968 | Roth . | |
| 3,858,877 | 1/1975 | Lundstrom . | |
| 3,985,355 | 10/1976 | Shoemaker . | |

*Primary Examiner*—Richard C. Pinkham
*Assistant Examiner*—T. Brown
*Attorney, Agent, or Firm*—Pravel, Gambrell, Hewitt, Kirk & Kimball

[57] ABSTRACT

A portable game surface for playing a pool-like game is created by apparatus including a sheet of flexible material for forming the game surface, a plurality of discrete structural elements capable of being mounted to the flexible material to define the boundaries of the game surface and to form bumper rails for movable objects, first elements for connecting the structural elements lengthwise to the flexible material such that the flexible material will cover the surface portion of the bumper rails which will be engaged by movable objects, second elements releasably and rigidly connecting adjacent ends of the structural elements to form the boundaries of the game surface and to maintain the game surface in taut playable form, pocket elements formed at locations where the bumper rails are connected by the second elements, the structural elements are capable of being disconnected from each other and from the sheet of flexible material so that the game surface can easily be dismantled.

6 Claims, 5 Drawing Figures

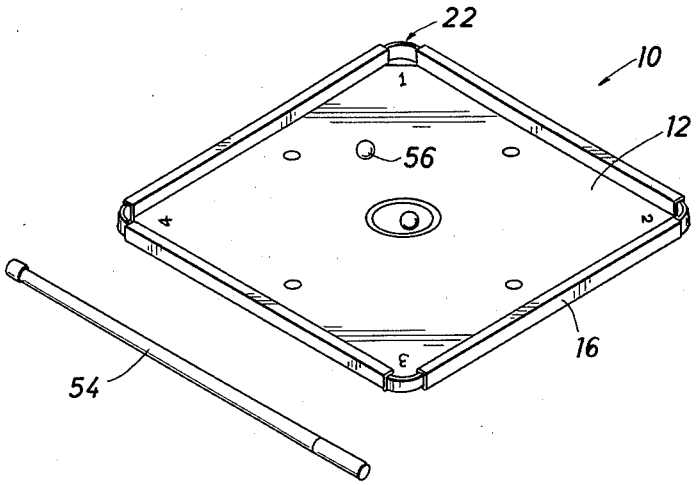
FIG. 1
FIG. 2
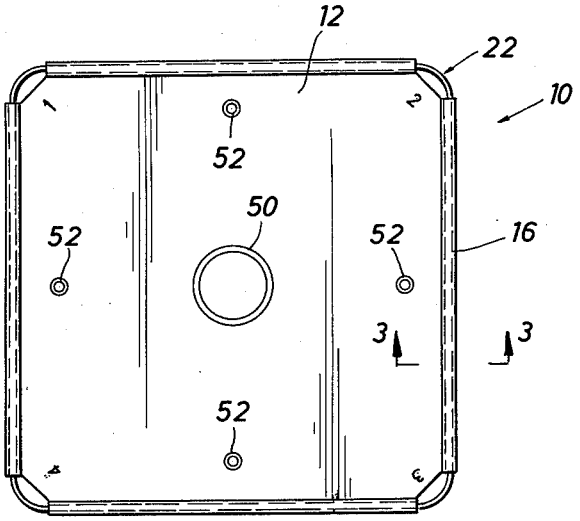
FIG. 3
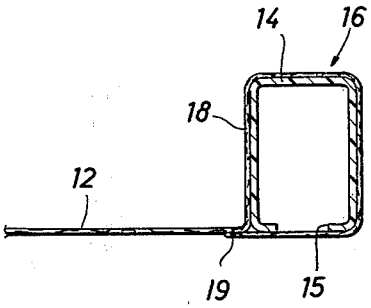
FIG. 4
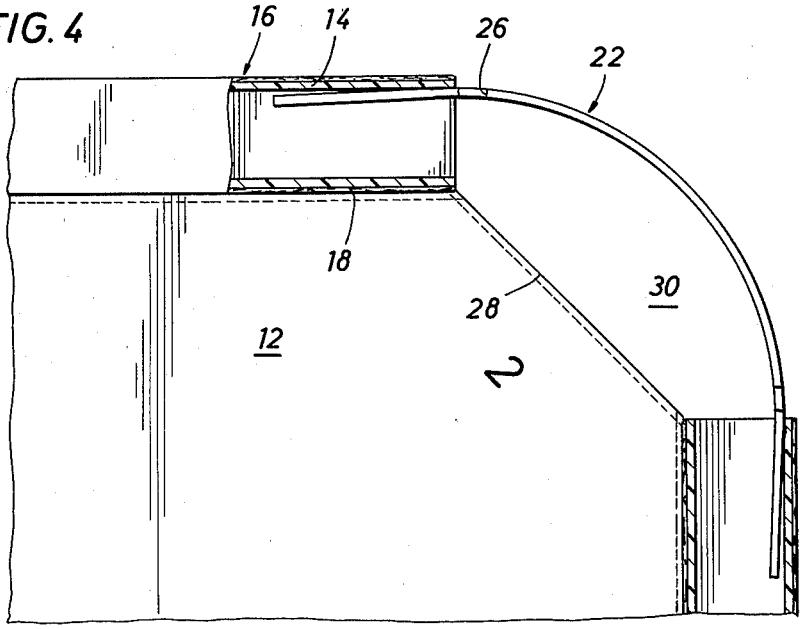
FIG. 5
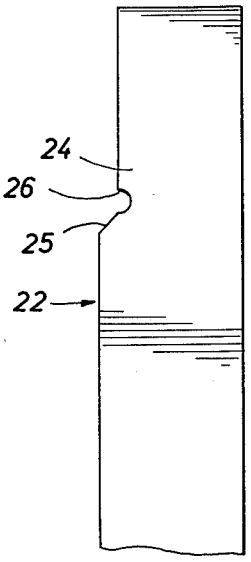

PORTABLE GAME SURFACE FOR A POOL-LIKE GAME

FIELD OF THE INVENTION

This invention relates to game surfaces and, more specifically, to a portable game surface for a pool-like game.

PRIOR ART

Many games include movable objects which are placed on a surface and then struck so as to hit other movable objects along portions of the playing surface in a designated manner. One of the most common of these games is pool, where balls are placed on a game surface and then one ball is struck by a stick or cue so as to strike other balls and move the other balls toward pockets arranged adjacent the game surface. The balls bounce in a controllable manner off of a rigid bumper wall which surrounds the surface area. Such games are played on standard pool tables which are relatively large and heavy.

It is also possible to play similar games or pool-like games on portable structures which are smaller and lighter than standard-sized pool tables. Some devices attempt to convert ordinary tables into pool tables such as disclosed in U.S. Pat. Nos. 1,661,965 and 2,540,729. Others simply duplicate the pool table structure with only reduced dimensions such as shown in U.S. Pat. Nos. 2,462,526 and 3,591,176. Other patents have disclosed devices to make portable pool tables which are easily disassembled or made portable by being foldable into smaller areas. Such devices are disclosed in U.S. Pat. Nos. 1,669,822 and 2,809,040. Some of these devices are used to form surfaces for pool-like games and have a flexible sheet which is used as a playing surface held rigid by other portions of the game. Some are designed to be placed on other surfaces which act as an under-surface or support surface for the game. Because of the need to have a flat and taut playing surface, as well as rigid bumper rails when may be interspersed with pockets, even the portable and disassembled pool tables are of significant size and weight.

SUMMARY OF THE INVENTION

This invention provides a portable, lightweight and relatively small apparatus capable of forming a game surface on a flat support surface for a pool-like game. A sheet of flexible material to form the game surface is provided. Structural elements capable of connection to the flexible material are used to define the boundaries of the game surface and to form bumper rails for the movable objects used in the games. A first connecting means is used to connect the structural elements lengthwise to the flexible material such that the flexible material covers the portion of the bumper rails bumped by the movable objects. A second connecting means is used to rigidly connect the adjacent ends of the structural elements to form the boundaries of the game surface and to maintain the game surface in playable form. Pockets are formed at locations where the bumper rails are joined. The structural elements are capable of being manually disconnected from each other and from the sheet of flexible material so that the game surface may be easily dismantled.

The sheet of flexible material may be formed with straight edges which meet at truncated corners so that the pockets are formed between the truncated corners and the second connecting means. The first connecting means may be a loop formed along each edge of the flexible material which will receive the bumper rails. In a specific embodiment of the invention, the flexible material is marked with a large diameter circle approximately in the center of the flexible material and with smaller circles, each approximately halfway along an edge of flexible material and substantially adjacent to a bumper rail, so that a specific pool-like game may be played.

DESCRIPTION OF THE DRAWINGS

FIG. 1 is a perspective view of the apparatus forming the game surface assembled for use, with additional equipment for playing a pool-like game.

FIG. 2 is a top plan view of the apparatus as assembled.

FIG. 3 is a front section view, looking along a section line shown in FIG. 2 looking in the direction of arrows 3—3, showing a bumper rail.

FIG. 4 is a top plan view partially in section showing a pocket area.

FIG. 5 is a plan view of the second connecting means.

DESCRIPTION OF THE PREFERRED EMBODIMENT

Referring to the drawings, FIG. 1 shows the apparatus of the preferred embodiment of the present invention assembled to form a portable game surface generally designated by reference numeral 10 for a pool-like game in which movable objects are used. The game surface 10 is formed of a sheet 12 of smooth, flexible material such as felt. A plurality of discrete structural elements 14 are connected to the sheet 12 to define the boundaries of the game surface 10 and to form bumper rails 16. As shown best in FIGS. 3 and 4, the structural elements are formed of conduits with generally rectangular cross-sections although other shapes may be used. The conduits of the preferred embodiment are formed of a rigid thermo-plastic material which is open lengthwise along one side as indicated by reference numeral 15. This open portion allows the structural elements 14 to overlap each other when the apparatus is disassembled and stored in a container (not shown). The open portion should not be along the side of the conduits facing inwardly.

The structural elements 14 are connected lengthwise to the sheet 12 by a first connecting means in the form of a loop 18 of the flexible material of the sheet 12 such that the flexible material covers the surface portion of the bumper rail 16 which is contacted by the movable objects 56. The loop 18 is designed to securely hold the structural elements 14 along an edge of the game surface 10. The sheet 12 may be folded over the structural element 14 and then under itself to form the loop 18 which is fastened by a seam 19 running the length of the loop 18 (see FIG. 3). The seam 19 may be made by sewing or other well-known means.

A second connecting means in the form of a flexible plastic strip 22 of generally rectangular shape is used to rigidly connect adjacent ends of the structural elements 14 to each other to form the boundaries of the game surface 10 and to hold the sheet 12 in playable form. Each end 24 of the strip 22 is relatively narrow and designed to snugly fit within the conduit 14, as shown in FIG. 4, a shoulder 25 limiting the distance each end 24 can be inserted into a structural element 14. A curved notch 26 is formed at the inner end of the narrowed portion to reduce tearing.

Because the adjacent bumper rails 16 are disposed at right angles along the edges of the game surface 10, the flexible strips 22 are each flexed forming an arc as shown in FIG. 4. The corners of the sheet 12 are truncated along a line designed by reference numeral 28 so that a pocket 30 for the movable objects 56 is formed between the truncated line 28 and the flexed strip 22. The cooperating action of the four second connecting means 22 and the adjacent ends of the four structural elements 14 form a rigid frame preventing the flexible material from shifting relative to the bumper rails 16 of the game surface and maintain the game surface 10 in playable form.

As shown in FIG. 3, the bumper rails 16 are formed substantially perpendicular to the game surface portion of the sheet 12 and the material which makes up the sheet 12 covers the portion of the bumper rails 16 contacted by the movable objects so that a cushion effect is created similar to the cushion effect in a standard-sized pool table.

The flexible strips 22 and structural elements 14 are normally straight when the apparatus is dismantled. Portions of the structural elements 14 can be inserted in each other through the open portions 15 and all the components of the game can easily be rolled with the sheet 12 of flexible material into a compact bundle which may then be placed in a cylindrical container when not in use. Cue sticks, with which certain pool-like games are played, as well as the movable objects, may also be included in such a dismantled portable apparatus.

Assembly

To assemble the game surface 10, the sheet 12 is first rolled out flat. The structural elements 14 are inserted into the loops 18 with the open portion 15 of each conduit facing down. The narrow ends 24 of the strips 22 are inserted into the ends of the structural elements 14 until the shoulders 25 engage the ends of the structural elements 14. The edge of each strip 22 with the notch 26 and shoulder 25 should be facing up so that the other flat edge of the strip is next to the surface which is used to support the game. The structural elements are positioned perpendicular to each other which causes the strip 22 to flex and create the pocket 30. The other strips 22 are then inserted into other pairs of adjacent ends to form the other pockets and complete the game surface. The assembled game surface is then placed on a flat support surface wherever it is desired to play the game. In this way, a rigid frame with a taut and smooth playing field is created.

In one pool-like game which may be played with the apparatus as previously described, the sheet 12 of flexible material is marked with a large diameter circle 50 in approximately the center of the sheet 12 and with smaller diameter circles 52 substantially adjacent to each bumper rail 16 approximately half-way along each of the straight edges of the sheet 12. The large diameter circle 50 may be used to place the target objects or balls at the beginning of the game in a set circular formation and the smaller diameter circles 52 may be used to place shooting or cue balls to hit the target objects in the center of the large circle. Cue sticks such as those, for example, shown in FIG. 1 and designated by reference numeral 54 may be used to strike movable objects such as balls 56 and cause them to move. In one such game employing such markings, a plurality of target balls will be placed in the large diameter circle 50 and each player will place an identifiable cue ball on one of the small diameter circles 52. The cue balls may be different by colors and, if desired, the pockets may be colored or numbered to indicate correspondence with a particular cue ball. When a player's turn to shoot occurs, he must attempt to strike a target ball with his cue ball in such a way as to drive one or more of the target balls into his corresponding pocket. Points are awarded based on the number of target balls in each designated pocket at the end play.

The foregoing disclosure and description of the invention are illustrative and explanatory thereof and various changes in the size, shape and materials as well as the details of the illustrated construction may be made without departing from the spirit of the invention.

I claim:

1. Apparatus capable of forming a portable game surface on a flat support surface for a pool-like game in which movable objects are used, comprising:

a sheet of flexible material for forming the game surface;

a plurality of discrete structural elements capable of being connected to flexible material for defining the boundaries of the game surface and forming bumper rails for the movable objects;

first connecting means for connecting said structural elements lengthwise to said flexible material such that said flexible material covers the surface portion of said bumper rails contacted by the movable objects;

second connecting means for rigidly connecting adjacent ends of said structural elements to each other for forming the boundaries of the game surface and maintaining the game surface in playable form;

means forming pockets for the movable objects at locations where said bumper rails are joined;

said structural elements being capable of being manually disconnected from each other and from said sheet of flexible material so that the game surface can easily be dismantled; and each bumper rail includes a conduit with a generally rectangular cross-section.

2. The apparatus of claim 1, wherein:

said sheet of flexible material is formed with a plurality of substantially straight edges which meet at truncated corners, the truncated corners and second connecting means being shaped and dimensioned so that pockets are formed therebetween.

3. The apparatus of claim 2, wherein:

said first connecting means includes a loop formed along each edge of said flexible material which is capable of receiving at least one structural element.

4. The apparatus of claim 1, wherein :

said second connecting means includes a flexible connector element with end portions adapted to be inserted into and rigidly engage the ends of adjacent conduits; and said means for forming pockets including a central portion of said flexible connector element which is curved for forming a pocket for the movable objects when said end portions engage said conduits.

5. The apparatus of claim 4, wherein:

said structural elements and connector elements when the apparatus is dismantled are normally straight and when the sheet of flexible material is rolled up said flexible material, structural elements and connector elements can be placed in a cylindrical container.

6. The apparatus of claim 2, wherein:

said sheet of flexible material is marked with a large diameter circle approximately in the center of said sheet; and said sheet of flexible material is marked with a small diameter circle substantially adjacent each of said bumper rails, approximately half-way along each of said straight edges.

* * * * *